US007264130B2

(12) United States Patent
Sommerfeld et al.

(10) Patent No.: US 7,264,130 B2
(45) Date of Patent: Sep. 4, 2007

(54) HOUSING FOR LONG TRAVEL HIGH CAPACITY FRICTION DRAFT GEAR ASSEMBLY

(75) Inventors: Howard Sommerfeld, Oak Forest, IL (US); Michael E. Ring, Saint John, IN (US)

(73) Assignee: WABTEC Holding Corp., Wilmerding, PA (US)

( * ) Notice: Subject to any disclaimer, the term of this patent is extended or adjusted under 35 U.S.C. 154(b) by 0 days.

(21) Appl. No.: 10/927,911

(22) Filed: Aug. 27, 2004

(65) Prior Publication Data

US 2005/0155947 A1 Jul. 21, 2005

Related U.S. Application Data

(60) Provisional application No. 60/537,294, filed on Jan. 16, 2004.

(51) Int. Cl.
*B61G 9/00* (2006.01)

(52) U.S. Cl. ..... 213/31

(58) Field of Classification Search ..... 213/7, 213/8, 31, 32 R, 33, 75 R
See application file for complete search history.

(56) References Cited

U.S. PATENT DOCUMENTS 3,447,693 A * 6/1969 Cardwell ..... 213/22
3,741,406 A * 6/1973 Anderson ..... 213/22
5,443,170 A * 8/1995 Merker et al. ..... 213/32 C
5,452,814 A * 9/1995 Merker et al. ..... 213/32 C

* cited by examiner

*Primary Examiner*—S. Joseph Morano
*Assistant Examiner*—Robert J. McCarry, Jr.
(74) *Attorney, Agent, or Firm*—James Ray and Assoc.

(57) ABSTRACT

A friction-type draft gear assembly includes a housing having an open front and a closed rear end with a first and second rear portions and a pair of ledge members disposed intermediate such first and second rear portions and enabling the draft gear assembly to fit into a draft gear pocket of a predetermined length. A first rear portion is adapted to receive a compressible cushioning element with a seating arrangement abutting one end thereof which extends longitudinally from the second portion of the closed rear end toward the open front portion. The open front end is adapted to receive a friction cushioning element which has a spring release mechanism for continuously urging the friction cushioning element outwardly from the compressible cushioning element thereby releasing such friction cushioning element after compression of such draft gear assembly. The open front end may incorporate additional side members for direct attachment to a coupler.

26 Claims, 3 Drawing Sheets

HOUSING FOR LONG TRAVEL HIGH CAPACITY FRICTION DRAFT GEAR ASSEMBLY

CROSS-REFERENCE TO RELATED APPLICATIONS

This application is related to and claims priority from U.S. Provisional Patent Application Ser. No. 60/537,294 filed on Jan. 16, 2004. This application is further closely related to co-pending U.S. Ser. No. 10/927,910 filed on Aug. 27, 2004 and entitled "Long Travel High Capacity Friction Draft Gear Assembly", to co-pending U.S. Ser. No. 10/928,843 filed on Aug. 27, 2004 and entitled "Long Buff Short Draft Travel Draft Gear for Use in a 24.625 Inch Pocket", filed concurrently herewith. These applications are being assigned to the assignee of the present invention and the disclosures of these co-pending applications are hereby incorporated by reference thereto.

FIELD OF THE INVENTION

The present invention relates, in general, to friction-type draft gear assemblies for use in cushioning both buff and draft shocks normally encountered by railroad rolling stock during make-up and operation of a train consist on a track structure and, more particularly, this invention relates to a friction-type draft gear assembly having a longer travel.

BACKGROUND OF THE INVENTION

Friction type draft gear assemblies are widely used in United States railroad industry to provide protection to a railway car by absorbing shocks in both draft and buff conditions must meet various Association of American Railroads (AAR) requirements. In one aspect, draft gear must be capable of maintaining the minimum shock absorbing capacity during its service life required by AAR standard M-901-G to be at least 36,000 foot pounds being measured during a drop hammer test. In the other aspect, AAR mandates working action of such draft gear to be achieved without exceeding a 500,000 pound reaction pressure acting on the freight car sills in order to prevent upsetting the coupler shank. In a further aspect, the draft gear must fit into a standard railway car pocket of 24.62 inches in length.

U.S. Pat. Nos. 5,152,409, 5,590,797 and 3,368,698, all owned by assignee of the present invention and hereby incorporated by reference thereto, relate to commonly used friction draft gears, which are installed in alignment with a railway car center sill having a pair of front stops and a pair of rear stops. Such draft gears include a housing fitting entirely between the front and rear stops and having an open front portion disposed adjacent a pair of front stops and a closed rear portion which engages a pair of rear stops. A compressible cushioning element is positioned within the rear portion of the housing. A friction cushioning element is adopted in the front portion of the housing. The draft gears further include a spring release mechanism for continuously urging the friction cushioning element outwardly from the compressible cushioning element thereby releasing such friction cushioning element after compression of such draft gears. The compressible cushioning element is typically either of an all spring configuration as taught in U.S. Pat. Nos. 5,152,409 and 5,590,797 or of a spring and hydraulic assembly combination as taught in U.S. Pat. No. 3,368,698.

It is now known that certain railroads require a higher protection to the railway car by allowing an extended travel of about 4.75 inches in order to meet the requirements. At the same time, the draft gear with such extended travel must fit within the identical draft gear pocket length of 24.625 inches as the draft gears presently in use which are capable to travel only 3.25 inches.

SUMMARY OF THE INVENTION

The present invention provides a friction draft gear assembly for railway car stock having a higher shock absorbing capacity while fitting into a standard 24.62 inch long draft gear pocket within the center sill. The friction draft gear assembly comprises a housing closed at one end and open at the opposed end. The housing has a dual rear chamber adjacent the closed end and a front chamber adjacent the open end which is in open communication with the dual rear chamber.

The dual rear chamber has a larger first rear portion and a smaller second rear portion disposed adjacent closed end a pair of ledge members disposed intermediate the first and second rear portions for enabling the second portion to fit between a pair of rear stops.

The first rear portion is adapted to receive a compressible cushioning element with a pair of spring elements which extend longitudinally from the second portion toward the open front portion.

The use of dual rear chamber enables employment of the longer spring elements, which in combination, enables a longer travel distance of 4.75 inches and, more importantly, enables the friction draft gear assembly to achieve a higher shock absorbing capacity while fitting into the standard draft gear pocket being 24.625 inches in length.

Alternatively, the second rear portion may be adapted to receive a compressible cushioning element being a hydraulic assembly or a well known elastomeric pad stack or any combination thereof.

Additionally, the open end may be provided with an extension portion incorporating standard yoke features for direct attachment to a coupler of such railway vehicle.

OBJECTS OF THE INVENTION

It is therefore one of the primary objects of the present invention is to provide a friction draft gear assembly which protects a railway car by absorbing shocks in both draft and buff conditions.

A further object of the present invention is to provide a friction draft gear assembly having a higher shock absorbing capacity then draft gear assemblies presently in use.

Another object of the present invention is to provide a friction draft gear assembly having a higher shock absorbing and having a longer travel distance.

Yet another object of the present invention is to provide a friction draft gear assembly having a higher shock absorbing capacity and having a longer travel distance while fitting into a 24.625 inches long pocket.

Additional object of the present invention is to provide a friction draft gear assembly having a higher shock absorbing capacity and having a longer travel distance capable of direct attachment to a coupler of the railway car.

These and various other objects and advantages to the present invention will become more apparent to those persons skilled in the relevant art from the following more detailed description, particularly, when such description is taken in conjunction with the attached drawings and the appended claims.

Figure 1:
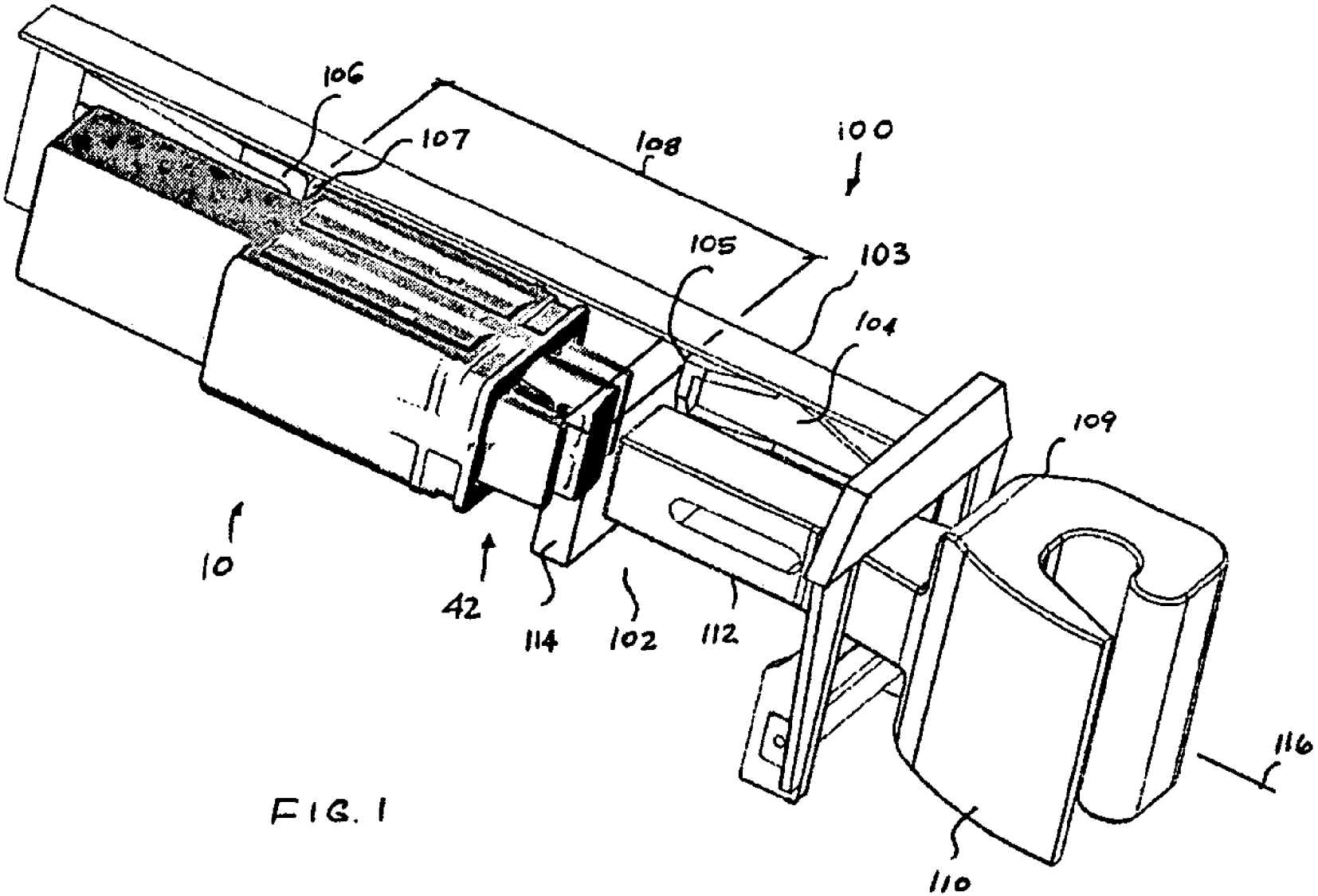
FIG. 1 is a perspective view of a friction draft gear assembly of the present invention as installed into a 24.625 inch long railway car pocket, partially illustrated.

DETAILED DESCRIPTION OF THE PREFERRED AND ALTERNATIVE EMBODIMENTS OF THE INVENTION

Prior to proceeding to the more detailed description of the present invention, it should be noted that for the sake of clarity identical components, having identical functions have been identified with identical reference numerals throughout the several views, which have been illustrated in the drawing figures.

The present invention enables a higher shock absorbing capacity of the friction draft gear assembly having a longer travel distance of 4.75 inches and fitting into a 24.625 inch long pocket by employing a novel housing construction having an extended rear portion, which enables adaptation of a longer spring design resulting in a longer travel distance and, more importantly, in a higher shock absorbing capacity.

Referring to the present invention, as shown in FIG. 1, a friction draft gear assembly, generally designated 10, of the present invention is disposed within a cavity 102 of a center sill, generally designated 100, of a railway car which is not shown, but is well known in the art. A front stop 104 and an axially opposed rear stop 106 are attached to each side member 103 of the center sill 100 and form a draft gear pocket 108 of a first predetermined length being 24.625 inches. A coupler arm 112 of a coupler 109 extends from a typical coupler knuckle 110 into the pocket 102. The coupler 109 is generally disposed along the longitudinal axis 116 of the center sill 100. The knuckle 110 of the coupler arm 109 engages a similar member protruding from a second railway car or locomotive to connect the railway cars for travel along railway tracks. A front coupler follower 114 is disposed intermediate the coupler arm 112 and the friction draft gear assembly 10 for evenly transmitting the shock from the coupler knuckle 110.

The friction draft gear assembly 10 includes a housing, generally designated 12, having a first closed end which is oriented toward the rear stops 106 and a second open end which is oriented toward the coupler 109. The first closed end comprises a first rear portion 13 having a first predetermined cross-section and a second predetermined length and a second rear portion 15 having a second predetermined cross-section and a third predetermined length and being axially aligned with the first rear portion 13. The second rear portion 15 is disposed adjacent a bottom wall 16 which, in combination, close the end of the housing 12. A pair of ledge members 14 having a predetermined width are disposed intermediate the first and second rear portions 13 and 15 respectively and abut a working surfaces 107 of the pair of the rear stops 106. Such pair of ledge members 14 enables the second rear portion 15 of the first closed end to extend into such sill 100 past the working surface 107 of the rear stops 106. It will be appreciated that such second rear portion 15 will be at least partially disposed intermediate such rear stops 106.

A front portion 20 of the second open end of the housing 12 having a third predetermined cross-section and a forth predetermined length is disposed adjacent the first rear portion 13. Such front portion 20 is axially opposed to the first closed end and is maintained in open communication therewith. Preferably, such third predetermined cross-section is equal to the first predetermined cross-section of the first rear portion 13.

The second rear portion 15 is adapted for receiving therein a compressible cushioning means, generally designated 18, which has one end thereof abutting at least a portion of an inner surface 22 of the bottom wall 16 of the housing 12.

A positioning means 36 disposed adjacent the inner surface 22 of the bottom wall 16 may be provided for maintaining that end of the compressible cushioning element 18 centrally located within the second rear portion 15 of the housing 12 during compression and extension of such compressible cushioning element 18.

Figure 2:
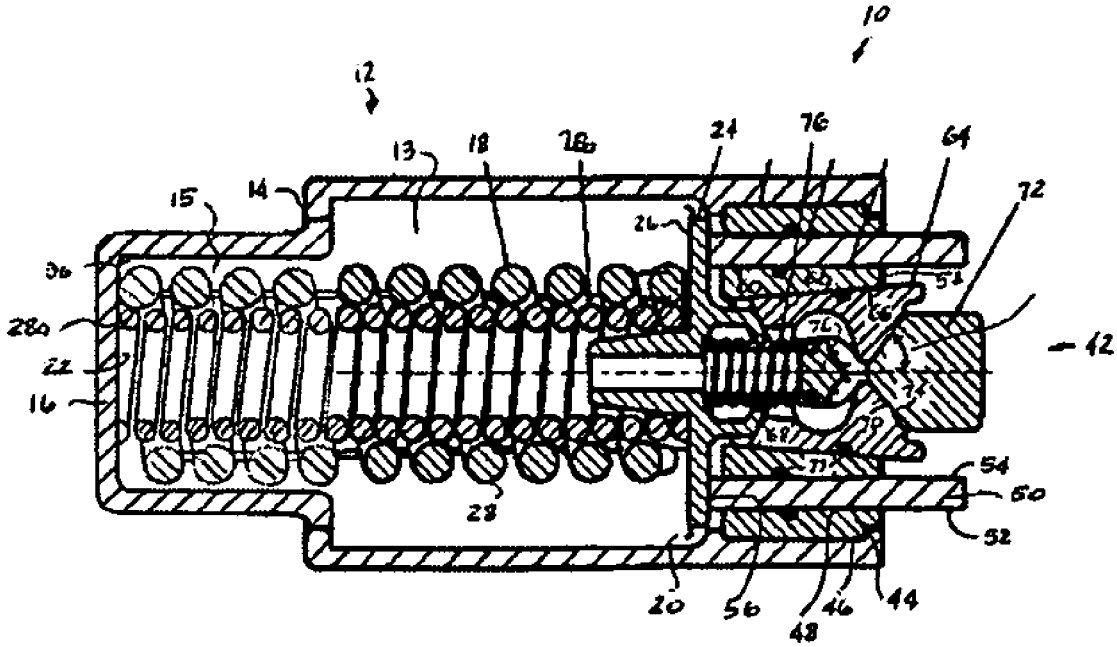
FIG. 2 is a longitudinal cross-sectional view of a friction draft gear assembly of the present invention.

As best shown in FIG. 2, the compressible cushioning element 18 further extends into the first rear portion 13.

The compressible cushioning element 18 may comprises at least one cushioning spring and a hydraulic assembly as taught by U.S. Pat. No. 3,368,698, or at least one elastomeric pad stack as taught by U.S. Pat. No. 6,488,162 and U.S. Pat. No. 6,446,820, but preferably the compressible cushioning element 18 comprises at least one cushioning spring 28, and, yet more preferably, the compressible cushioning element 18 comprises a pair of first and second resilient compression means, being a pair of first and second spring elements 28 and **28*a* respectively. The pair of first and second spring elements 28 and 28*a* respectively having a fifth predetermined length and a first and second predetermined spring rates respectively to enable the higher shock absorbing capacity of the friction draft gear assembly 10 in combination with the housing 12 having a second rear portion 15**.

A seat means 24 abutting the pair of first and second springs 28 and **28*a* respectively is adapted within the housing 12 for longitudinal movement therein for respectively compressing and releasing the compressible cushioning element 18 during application and release of a force on the draft gear assembly 10**.

A friction cushioning means, generally designated as 42, is disposed at least partially within the front portion 20 of the housing 12. The friction cushioning means 42 absorbs energy during application of a force sufficient to cause a compression of the draft gear assembly 10.

Those skilled in the art will understand that a combination of the second predetermined length of the first rear portion 13, the forth predetermined length of the front portion 20, the exposed portion of the friction cushioning means 42 and the predetermined thickness of the coupler follower 114 will be about equal or slightly smaller that the first predetermined length of the draft gear pocket 108.

The friction cushioning means 42 includes a pair of laterally spaced outer stationary plates 44 having an inner friction surface 48 and an opposed outer surface 46 engaging the housing 12.

A pair of laterally spaced movable plates 50 of substantially uniform thickness having an outer friction surface 52 and an inner friction surface 54 and at least one substantially flat edge 56 intermediate the outer friction surface 52 and an inner friction surface 54 is disposed within the open end of the draft gear assembly 10. The inner friction surface 54 having an edge 56 thereof engaging the seat means 24. At least a portion of the outer friction surface 52 movably and frictionally engages the inner friction surface 48 of the outer stationary plate 44.

A pair of laterally spaced tapered plates 58 having an outer friction surface 60 and an opposed inner friction surface 62 are adapted adjacently such movable plates 50. The outer friction surface 60 movably and frictionally engages at least a portion of the inner friction surface 54 of the movable plate 50.

The friction cushioning means 42 further includes a pair of laterally spaced wedge shoes 64 which have at least a portion of an outer friction surface 66 movably and frictionally engaging at least a portion of the inner friction surface 62 of the tapered stationary plate 58. Wedge shoes 64 have at least a portion of one edge 68 engaging seat means 24 and a predetermined tapered portion 70 on an opposed edge thereof.

A center wedge 72 having a pair of matching tapered portions 74 for engaging the tapered portion 70 of the wedge shoe 64 is provided to initiate frictional engagement of the friction cushioning means 42.

The friction draft gear assembly 10 additionally includes a spring release means 76 engaging and extending longitudinally between the seat means 24 and the center wedge 72 for continuously urging the friction cushioning mean 42 outwardly from the compressible cushioning means 18 to release the friction cushioning means 42 when an applied force compressing the friction draft gear assembly 10 is removed.

In operation upon impact into a coupler knuckle 110 the buffing shock is transmitted from the coupler arm 112 through the coupler follower 114 to the central wedge 72, causing it to act through the wedge shoes 64 and thereby compress all of the cushioning elements simultaneously. These parts will furnish sufficient cushioning for light buffing shocks. After a suitable travel, however, the coupler follower 114 will abut the outer ends of the movable plates 50 introducing energy-absorbing friction between the movable plates 50 and the stationary plates 58 and 44 which have been pressed together by the action of the wedge shoes 64. As this action continues, the pressure between the adjacent surfaces of the intercalated plates has been enormously increased due to the fact that the wedge shoes 64 are loaded against the cushioning mechanism 42. The energy absorption and dissipation through friction and compression of the cushioning mechanism continues until the friction draft gear assembly 10 is closed including compression of cushioning element 18. Extension of such cushioning element 18 into the second rear portion 15 of the housing 12 enables a longer travel thereof and, more importantly, enables the friction draft gear assembly 10 to absorb higher buffing shocks from the coupler 109.

During release of the friction draft gear assembly 10, the compressible cushioning element 18 is maintained in alignment by the seat means 24.

Figure 3:
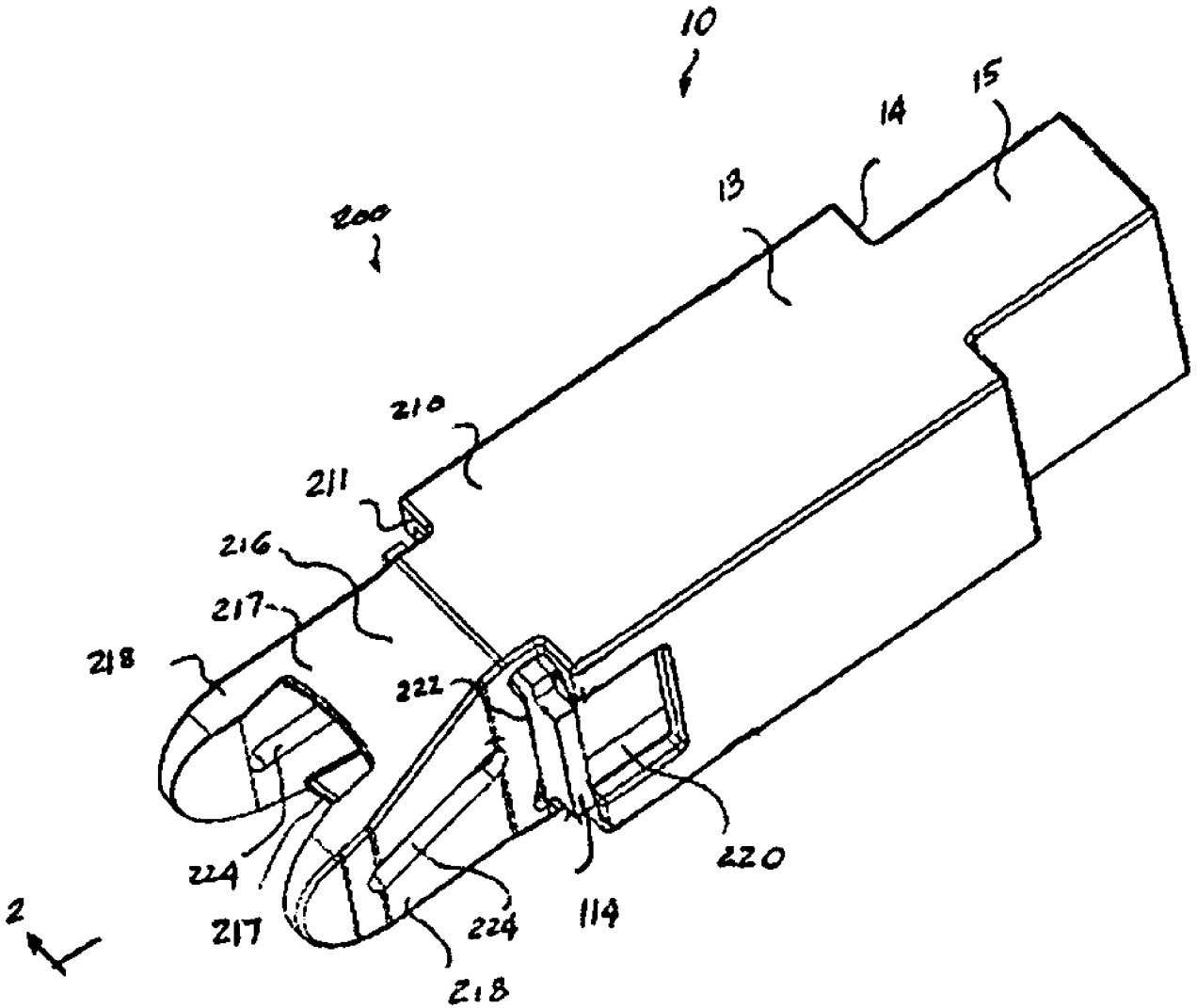
FIG. 3 is a perspective view of the friction draft gear assembly of the present invention having an integrated yoke portion for direct attachment to a coupler of a railway car.

The housing, generally designated 200, for a friction draft gear assembly 10 containing an integral yoke portion, best shown in FIG. 3, has a pair of opposed first follower apertures 220 having a fifth predetermined length and a first predetermined height which are disposed within the first front portion 210 of the second open end. A second front portion 216 extends outwardly from the first front portion 210 and contains a pair of oppositely disposed vertical side members 218. Each side member 218 is adapted with a second follower aperture 222 of a sixth predetermined length and a second predetermined height and a longitudinally disposed aperture 224 for attachment to coupler arm 112 with a standard coupler key (not shown).

Preferably, a pair of oppositely disposed horizontal surfaces 217 is provided intermediate the side members 218 forming a box like structure, best illustrated in FIG. 1, for reinforcing structural integrity of such vertical side members 218 during operation of the friction draft gear assembly 10.

Those skilled in the art will readily understand that a pair of opposed round apertures may be disposed within such horizontal surfaces 217 for attachment to a coupler 109 being of a standard F-shank coupler with a coupler pin (not shown)

A pair of front ledge members 211 having a second predetermined width are disposed intermediate the first and second front portions 210 and 216 respectively and abut the working surface 105 of each of the front stops 104 with the friction draft gear assembly 10 being at the end of a full draft travel.

Although a presently preferred and various alternative embodiments of the present invention have been described in considerable detail above with particular reference to the drawing FIGURES, it should be understood that various additional modifications and/or adaptations of the present invention can be made and/or envisioned by those persons skilled in the relevant art without departing from either the spirit of the instant invention or the scope of the appended claims.

We claim:

1. A housing for a long travel high capacity railway car friction-type draft gear assembly which enables the cushioning of buff and draft shocks that are usually encountered in such railway car rolling stock during a coupling operation of such railway car to a train consist and during normal operation of such train consist on a track structure, such buff and draft shocks transmitted by a coupler and a coupler follower of such railway car, such coupler follower having a first predetermined thickness, such draft gear assembly disposed within a center sill of such railway car intermediate a pair of front stops and an axially opposed pair of rear stops, such front and rear stops forming a draft gear pocket having a first predetermined length of 24.625 inch, said housing comprising:

(a) a first end having a first portion of a first predetermined cross-section and a second predetermined length, a second portion of a second predetermined cross-section and a third predetermined length being axially aligned with said first portion, said second portion closed by an end wall, and a pair of ledge members having a predetermined width disposed intermediate said first and second portions and abutting a working surface of each of such rear stops;

(b) a second end having a forth predetermined length being disposed adjacent said first portion of said first end, said second end being axially opposed to said first end and further being in open communication with said first portion thereof, wherein opposed vertical inner wall surfaces of said second end are disposed in a parallel relationship to one another and disposed in a planar relationship to respective wall surfaces of said first portion of said first end and wherein at least a portion of each of said vertical inner wall surface abuts a respective stationary member of a friction cushioning mechanism of the draft gear; and (c) whereby said pair of ledge members enabling extension of said second portion of said first end into such sill past said working surfaces of such pair of rear stops for disposition intermediate such rear stops, said extension enabling longer travel of such draft gear assembly while retaining an ability of such draft gear to fit into such 24.625 inch pocket.

2. A housing for a long travel high capacity railway car friction-type draft gear assembly according to claim 1, wherein said end wall having an inner surface.

3. A housing for a long travel high capacity railway car friction-type draft gear assembly according to claim 2, wherein said first end further includes a positioning means disposed adjacent said inner surface of said end wall for centrally maintaining one end of a compressible cushioning element disposed in said second portion of said first end during compression and extension of said compressible cushioning element, said one end abutting at least a portion of said inner surface of said end wall closing said first end of said housing, said compressible cushioning element extending longitudinally from said inner surface of said end wall into said first portion of said first end.

4. A housing for a long travel high capacity railway car friction-type draft gear assembly according to claim 3, wherein said compressible cushioning element includes at least one resilient compression means of a fifth predetermined length.

5. A housing for a long travel high capacity railway car friction-type draft gear assembly according to claim 4, wherein said at least one resilient compression means is at least one of spring element, hydraulic assembly, elastomeric pad stack, and combination thereof.

6. A housing for a long travel high capacity railway car friction-type draft gear assembly according to claim 5, wherein said at least one resilient compression means is a pair of a first spring element having a first predetermined spring rate and a second spring element having a second predetermined spring rate.

7. A housing for a long travel high capacity railway car friction-type draft gear assembly according to claim 3, wherein said first portion of said first end is adapted to receive a seat means having at least a portion of one surface thereof abutting an axially-opposite end of said compressible cushioning element and mounted to move longitudinally within said housing for respectively compressing and releasing said compressible cushioning element during application and release of a force exerted on such draft gear assembly.

8. A housing for a long travel high capacity railway car friction-type draft gear assembly according to claim 1, wherein said second end is adapted for at least partially receiving a friction cushioning means for absorbing energy during a compression of such draft gear assembly and a spring release means engaging and longitudinally extending between said seat means and said friction cushioning means for continuously urging said friction cushioning means outwardly from said compressible cushioning means to release said friction cushioning element when an applied force compressing such draft gear assembly is removed.

9. A housing for a long travel high capacity railway car friction-type draft gear assembly according to claim 3, wherein a combination of said second predetermined length of said first portion, said forth predetermined length of said second end, an exposed portion of said friction cushion means and said first predetermined thickness of such coupler follower is being one of equal to and smaller than 24.625 inch long draft gear pocket.

10. A housing for a long travel high capacity railway car friction-type draft gear assembly according to claim 1, wherein said second end further includes a pair of oppositely disposed vertical side members extending outwardly therefrom.

11. A housing for a long travel high capacity railway car friction-type draft gear assembly according to claim 10, wherein each of said pair of vertical side members includes a longitudinally disposed aperture for attachment to such coupler arm with a standard coupler key.

12. A housing for a long travel high capacity railway car friction-type, draft gear assembly which enables the cushioning of buff and draft shocks that are usually encountered in such railway car rolling stock during a coupling operation of such railway car to a train consist and during normal operation of such train consist on a track structure, such buff and draft shocks transmitted by a coupler of such railway car, such draft gear assembly disposed within a center sill of such railway car between a pair of front stops and an axially opposed pair of rear stops, such front and rear stops forming a draft gear pocket having a first predetermined length of 24.625 inch, said housing comprising:

(a) a first end having a first rear portion of a first predetermined cross-section and a second predetermined length, a second rear portion of a second predetermined cross-section and a third predetermined length being axially aligned with said first portion, said second portion closed by an end wall and a pair of rear ledge members having a first predetermined width disposed intermediate said first and second rear portions and abutting a working surface of each of such rear stops;

(b) a second end having a first front portion of a third predetermined cross-section and a forth predetermined length being disposed adjacent said first portion of said first end, said second end being axially opposed to said first end and further being in open communication with said first rear portion thereof, a second front portion extending outwardly from said first front portion and having means disposed therein for attachment to such coupler;

(c) whereby a combination of said second predetermined length of said first rear portion and said forth predetermined length of said first front portion is being one of equal to and smaller than such 24.625 inch long draft gear pocket; and (d) whereby said pair of rear ledge members enabling said second rear portion of said first end to extend into such sill intermediate such pair of rear stops past said working surfaces thereof.

13. A housing for a long travel high capacity railway car friction-type draft gear assembly according to claim 12, wherein said second end includes a pair of front ledge members having a second predetermined width disposed intermediate said first and second front portions.

14. A housing for a long travel high capacity railway car friction-type draft gear assembly according to claim 12, wherein said first front portion includes a pair of opposed first follower apertures having a fifth predetermined length and a first predetermined height and abutting said pair of front ledge members.

15. A housing for a long travel high capacity railway car friction-type draft gear assembly according to claim 12, wherein said second front portion includes a pair of oppositely disposed vertical side members.

16. A housing for a long travel high capacity railway car friction-type draft gear assembly according to claim 15, wherein said second end includes a pair of opposed second follower apertures of a sixth predetermined length and a second predetermined height, each of said second follower apertures disposed in one of said first front portion and said vertical side member of said second front portion of said second end.

17. A housing for a long travel high capacity railway car friction-type draft gear assembly according to claim 16, wherein said fifth predetermined length of said pair of said first follower apertures is one of larger and equal than said sixth predetermined length of said pair of said second follower apertures.

18. A housing for a long travel high capacity railway car friction-type draft gear assembly according to claim 17, wherein said fifth predetermined length of said pair of said first follower apertures is larger than said sixth predetermined length of said pair of said second follower apertures.

19. A housing for a long travel high capacity railway car friction-type draft gear assembly according to claim 15, wherein said means for attachment to such coupler includes a pair of elongated apertures each longitudinally disposed in each of said vertical side members for attachment to a coupler arm with a standard coupler key.

20. A housing for a long travel high capacity railway car friction-type draft gear assembly according to claim 12, wherein said second front portion further includes a pair of opposed horizontal surfaces disposed intermediate said vertical side members forming a box like shaped structure.

21. A housing for a long travel high capacity railway car friction-type draft gear assembly according to claim 20, wherein said means for attachment to such coupler disposed within said second end includes a pair of opposed apertures each disposed within a respective one of said opposed horizontal surfaces for attachment to a coupler arm with a standard coupler pin.

22. A housing for a long travel high capacity railway car friction-type draft gear assembly according to claim 12, wherein said third predetermined cross-section of said first front portion is equal to said first predetermined cross-section of said first rear portion.

23. A housing for a long travel high capacity railway car friction-type draft gear assembly according to claim 12, wherein said second open end is adapted for completely receiving a friction cushioning means for absorbing energy during a compression of such draft gear assembly and a spring release means engaging and longitudinally extending between said seat means and said friction cushioning means for continuously urging said friction cushioning means outwardly from said compressible cushioning means to release said friction cushioning element when an applied force compressing such draft gear assembly is removed.

24. A housing for a high capacity railway car friction-type draft gear assembly which enables the cushioning of buff and draft shocks that are usually encountered in such railway car rolling stock during a coupling operation of such railway car to a train consist and during normal operation of such train consist on a track structure, such buff and draft shocks transmitted by a coupler of such railway car, such draft gear assembly disposed within a center sill of such railway car between a pair of front stops and an axially opposed pair of rear stops, such front and rear stops forming a draft gear pocket having a first predetermined length of 24.625 inch, said housing comprising:

(a) a first end having a first predetermined cross-section and a second predetermined length, said first end closed by an end wall, said end wall abutting a working surface of each of such rear stops;

(b) a second end having a first front portion of a third predetermined cross-section and a forth predetermined length being disposed adjacent said first end, said second end being axially opposed to said first end and further being in open communication therewith, a second front portion extending outwardly from said first front portion for attachment to such coupler; and (c) a pair of opposed follower apertures having a predetermined length, said pair of opposed follower apertures disposed within said second end for receiving a coupler follower.

25. A housing for a high capacity railway car friction-type draft gear assembly according to claim 24, wherein said predetermined length of said pair of said opposed follower apertures is equal to a travel distance of such high capacity railway car friction-type draft gear.

26. A housing for a high capacity railway car friction-type draft gear assembly according to claim 24, wherein said second end includes a pair of front ledge members having a second predetermined width disposed intermediate said first and second front portions.

* * * * *